United States Patent [19]

Tenney et al.

[11] Patent Number: 4,951,832

[45] Date of Patent: Aug. 28, 1990

[54] MULTI-FUNCTIONAL SPACE SAVING CONTAINER SYSTEM

[76] Inventors: Brian J. Tenney; Kerry L. Tenney, both of 3371 Merrimac Dr., San Jose, Calif. 95117-3623

[21] Appl. No.: 416,049

[22] Filed: Oct. 2, 1989

[51] Int. Cl.[5] ..... B65D 21/02; B65D 41/18

[52] U.S. Cl. ..... 220/23.83; 220/212; 206/505; 206/514

[58] Field of Search ..... 220/23.86, 23, 212, 220/23.83; 206/499, 514, 505

[56] References Cited

U.S. PATENT DOCUMENTS

| | | | |
|---|---|---|---|
| 109,739 | 11/1870 | Huntly | 206/499 X |
| 1,542,115 | 6/1925 | Weis | 220/23.2 |
| 1,778,175 | 10/1930 | Thune | 220/352 |
| 2,351,306 | 6/1944 | Tuthill | 206/499 |
| 2,412,325 | 12/1946 | Devine et al. | 220/23.83 X |
| 2,575,770 | 11/1951 | Roop | 206/514 |
| 2,766,796 | 10/1956 | Tupper | 220/23 |
| 2,980,280 | 4/1961 | Herlow | 220/23.83 |
| 3,079,037 | 2/1963 | Schechter | 220/212 |
| 3,338,468 | 8/1967 | Wilson | 206/508 |
| 4,047,329 | 9/1977 | Holt | 220/69 X |
| 4,512,493 | 4/1985 | Von Holdt | 220/270 X |
| 4,572,374 | 2/1986 | Sirotkin | 206/505 X |

OTHER PUBLICATIONS

The Tupperware Collection Catalog, Summer 1989.
Rubbermaid Catalog, 1988.

*Primary Examiner*—Paul T. Sewell
*Assistant Examiner*—Jacob K. Ackun, Jr.
*Attorney, Agent, or Firm*—Jacques M. Dulin

[57] ABSTRACT

A set of containers, preferably graduated and conveniently ranging in size generally from ½ pint to 1 gallon, each having a lid that may be placed on top to seal its respective, container and also may be matingly attached to the bottom in order that a smaller container with lid attached may be nested in the next larger container for convenient storage without loss or misplacing the lid. The lid attached to the bottom is configured to provide a uniform space between the vertical sides and the bottoms of nested containers so that two nested containers may provide a double walled container with an air gap acting as thermal insulation. Each lid may have a rim with a scalloped outside surface to prevent trapping of air in the nested position that could otherwise impede removal of the container and its lid from a larger container. A flange or downturned lip may be provided adjacent the upper rim of the container to assist in supporting a smaller inner container or a larger in a spaced relationship. A preferred embodiment employs a button (or knob) in the lid to engage an appropriately shaped and sized recess in the bottom of the container or vice versa.

20 Claims, 2 Drawing Sheets

MULTI-FUNCTIONAL SPACE SAVING CONTAINER SYSTEM

FIELD

This invention relates to containers of the type used, for example, to store food in refrigerators, etc., and especially to containers designed to nest together when stored in order to conserve space and which involves a special lid design by which the lids may be stored with their individual containers.

BACKGROUND INFORMATION DISCLOSURE STATEMENT

This background information also serves as Applicant's Information Disclosure Statement.

Modern methods of housekeeping have generated a need for "sets of containers" used for such purposes as the storage of food in refrigerators or freezers and heating food in microwave ovens. The modern housewife wants a collection of containers having a range of sizes, typically from a fraction of a pint up to a gallon. The desire for a range of sizes is generated by the need to store in the refrigerator various quantities of food. Refrigerator space is precious since there always seems to be enough leftovers, etc. to fill the refrigerator to near capacity. A similar need applies to microwave ovens. It is most desireable to have a collection of containers whose sizes vary from a "one helping" size (half pint) to a gallon or half-gallon size. It is a further requirement when storing containers of food in a refrigerator that the container be equipped with a lid that is fitted very well to the container, so each container must have its own lid. Having all of these containers on hand is convenient when they are to be used. However, the problem arises as to how the container may be stored when it is not in use. Equally vexing is the problem of storing the lid so that it can be conveniently retrieved for use with its one particular container. Yet another problem is to withdraw a particular size container from a collection of containers when each container resembles a number of other containers of approximately the same size. A housewife would greatly value going to a storage shelf, and immediately withdrawing the container and its particular lid that she requires, rather than pulling out a container that "looks similar" and then sorting out the lid to fit the container from a separate pile of lids stored nearby.

Another problem associated with the containers is to maintain the temperature of the food after it has been withdrawn from the refrigerator or microwave oven. The user wants some foods (ice cream, etc.) to remain cold and other foods (soups, etc.) to remain hot.

An additional problem is that a container of cold food will tend to sweat. If the container is placed on fine furniture, water condensing on the side of the container will mar the surface of the furniture. If the container is withdrawn from a microwave oven so that is contains hot food, the container can mar a surface of fine furniture if it is laid thereon. In addition, the container may be so hot that it cannot be handled for a number of minutes.

As an example of a container of the general type to which this application is directed, U.S. Pat. No. 4,047,329 to Holt is a container intended to be used to store foods, cosmetics, medicines, nursery products, etc. The Holt container has a molded lid that snaps over an upper rim of the container in order to protect contents of the container. The lid is also designed so that the container may rest on top of the lid, in which case the container-lid arrangement is a convenient flower pot. Design of the lid is such that the flower pot can be hung with the lid attached.

U.S. Pat. No. 3,079,037 to Schecter is for a lid and container of semiflexible plastic wherein the lid can be resealed onto the top of container as required or the lid can function as a tray under the container.

There is also some prior effort directed toward conserving space required to store the containers when they are not in use.

For example, U.S. Pat. No. 1,542,115 to Weis is for a combination of containers designed so that a large container can be placed on top of two small containers.

U.S. Pat. No. 4,512,493 to Von Holdt is for a bucket having a lid designed to support a stack of buckets (one on top of another) for high stacking strength.

U.S. Pat. No. 3,338,468 to Wilson is for a receptacle that is generally rectangular receptacle wherein the lid of one container is contoured to provide for stable stacking of the containers on top each other.

Other constructions related to sealing are also disclosed in the literature such as described in U.S. Pat. No. 2,766,796 to Tupper which describes a vacuum seal.

All of these problems listed above, taken together, have not been addressed by a set of containers having a singular design.

THE INVENTION

1. Objects:

It is an object of this invention to provide a collection of nestable containers of graduated sizes useful to store food in a refrigerator, heat in a microwave oven, or as serving dishes, etc., each of which is fitted with a lid that is reasonably air tight for the purposes intended.

It is another object of this invention to provide a set of nestable containers having lids such that the container and its own lid are kept together while stored in a nested arrangement with other containers in a manner that conserves space, each different container size can be easily identified while in the stored arrangement, and both the container and the lid may be withdrawn simultaneously when it is desired to retrieve the container and lid from the nest.

Another object of this invention is to provide a set of graduated containers wherein a container and its next largest neighbor may be combined to form a single container having an inner and outer wall separated by an insulating air space so that hot foods will remain hot and can be handled more easily, and cold foods stored therein will remain cold and not cause the outer surface of the container to sweat.

Another object of this invention is to provide a container and lid design having mating surfaces so the lid may be secured to and retained by the container, yet the container/lid combination is fully nestable within larger containers of a graduated set.

Still other objects will be evident from the Specification Drawings and Claims.

2. Summary:

This invention is directed toward a collection of containers that may be used either singly or as a combination of two containers forming a single double-walled container to store food in a refrigerator, heat food in a microwave oven or to be used as a serving dish. The containers may be a graduated set storable as a set of nested containers. Each container has means for attaching the lid to the bottom of the container in a manner so that the container, having its lid attached to its bottom, may be stored in the next largest container and withdrawn conveniently from the nest when required. Since the lid and container need not be separated either when stored or in use, time spent in having to match scattered lids and containers is avoided.

The containers may have any convenient range of sizes, e.g., from ½ pint to 1 gallon. The lid may be fitted onto the top or attached to the bottom of its container. When the lid is fitted on top of its container, it functions as a seal for food inside the container.

There are a number of advantages attained by attaching the lid to the bottom of the container. When the lid is attached to the bottom of its container, both the lid and its container may be nested within the next largest container for convenient storage, and easily withdrawn from it without loss or misplacing the lid.

Generally the lid of a first (the inner) container has an outer diameter smaller than the inner diameter of a second (the outer) container in which it is nested so that the lid does not get wedged in the inside of the outer container and does not cause the lid from being removed from the bottom of its (inner) container. The lid may be mated to the bottom of its container throughout its area or only in selected portions, and may mate with the inner lid surface contacting the entire outer bottom surface of its container, or vice versa, upper surface of its container contacting the outer bottom surface of its container.

In a preferred embodiment, the outer surface of the lid has a central knob that wedgingly grips a mating recess in the center bottom of its container. This arrangement may be reversed, with a protrusion on the inner surface of the lid matingly engaging a recess in the outside bottom of the container. Conversely, a knob-like projection centered in the container bottom, but not extending below the generally planar resting surface of the container, can matingly engage a recess in either the inner or outer surface of the lid. The knob projection, and their mating recesses may be individually shaped for each size container, to assist the blind in using the sizes by feel, and to prevent the wrong lid from being associated with the wrong container.

Indicia indicating size of the container may be inscribed on the inside surface near the top edge of each container. The spacing maintained by the attached lids in the nested array maintains the indicia in view of the user so that he may conveniently select the container having the size that he desires.

When the container is used as a serving dish, the lid being attachable to the bottom of the container, serves as a coaster that protects fine table surfaces from heat, if the contents of the container are hot, or that protects fine table surfaces from water condensate running off the sides of the container when the contents of the container are cold.

In another application, a container with lid attached to its bottom, may be nested in the next largest container to provide a double walled container in which the lid maintains a uniform spacing between the vertical sides and bottoms of the containers. The lid of the largest container is placed over the double walled arrangement and seals both the smaller and larger containers.

In another embodiment, a lip is provided adjacent the top edge of each container so that the underside of the lip is in supporting contact with the top edge of the outer container when the two containers are nested. The lip can be grasped in order to aid in withdrawing a container and its lid from the stored nest. In addition, indicia printed on the lip indicates the size of the container (½ pint, etc.)

Another aid in withdrawing the container with lid attached to its bottom inside a larger container is to have a lid with a scalloped rim. This provides air passages for air to enter the space between bottom surfaces of the small and larger containers so that the lid is not stuck to the inside bottom of the large container by a "vacuum" effect.

The containers may be made having a number of shapes. These include nests of containers having circular, elliptical, or generally polygonal (square, rectangular, etc.) horizontal (plan view) cross-sections.

DRAWINGS

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
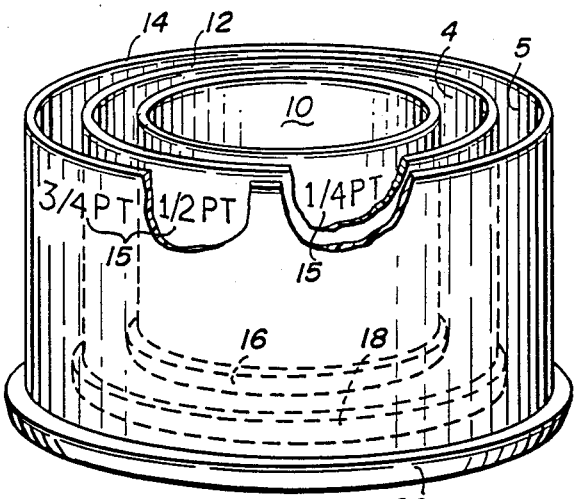
FIG. 1 shows a perspective view of a collection (graduated set) of nested containers in accord with this invention.

Turning now to the drawings for a detailed description, FIG. 1 shows a nest of three containers, 10, 12, and 14, with a lid (dashed lines) 16, 18 and 20 attached to the bottom of each container. The nest illustrates a major feature of the invention which is economy of space when the containers are empty and stored with the lids securely attached to the bottom. The inner surface of the lid is contoured to snap-fit on the bottom as shown. The bottom shoulder may be slightly flared at 2 to engage the inside curve 3 of the lid, or a groove-and-rib construction (not shown) may be employed.

A second feature is that the space 4, 5 between sidewalls of the containers maintained by the lids permits displaying indicia 15 indicating the size of the container.

Figure 2:
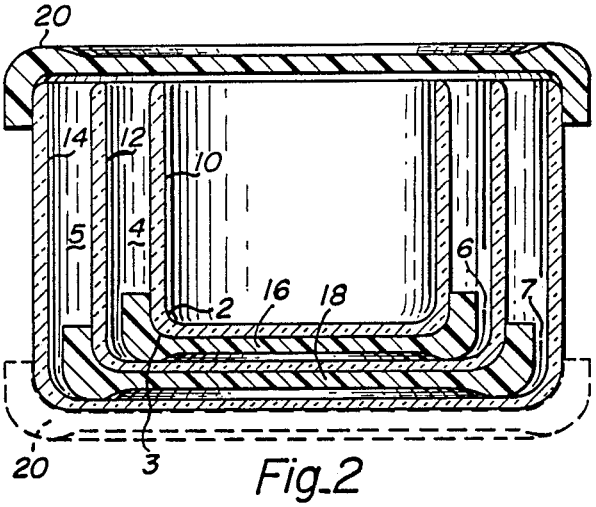
FIG. 2 shows a cross sectional view of the nested containers of FIG. 1.

FIG. 2 shows a cross sectional view of the nest of containers 10, 12 and 14, with corresponding lids, 16, 18 and 20 attached respectively to the bottom of each container. FIG. 2 illustrates the feature that each lid remains attached to its container when stored in the nest so that the user need not experience the frustration of having to match lid and container by a trial and error process when he wishes to withdraw lid and container from the nest in storage. Further, spaces or gaps 6 and 7 are provided between the outer edge of the lids and inner surface of the larger container prevent the lids from being wedged and stuck in the larger containers.

Figure 3:
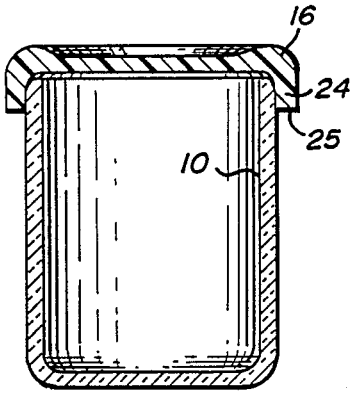
FIG. 3 shows a single container with lid.

FIG. 3 shows a cross sectional view of a single container 10 with its lid 16 in place for storing, e.g., food in a refrigerator. Note that the heavy lip 24 around the lid aids in sealing the lid to the container and prying the lid off the container when desired.

Figure 4:
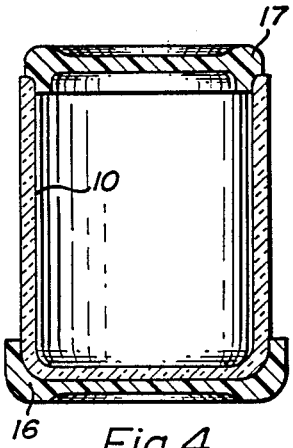
FIG. 4 shows a single container with a inner-fitting auxiliary lid on top, and an outer fitting lid attached to the bottom.

FIG. 4 shows the container 10 with lid 16 attached to its bottom to serve as a coaster to protect a fine table finish from either hot contents in container 12, or to catch condensate (water) running off the sides of container. An auxiliary inner lid 17 may be provided.

Figure 5:
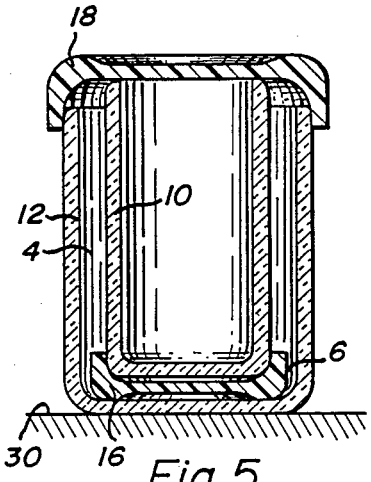
FIG. 5 shows two containers nested to form a single container with an insulating double wall, the inner container bottom-fitted lid providing the spacing required.

FIG. 5 shows a cross sectional view of a double wall arrangement that is useful for containing hot or cold food for placement on a dining room table top where damage to a fine surface is to be avoided.

The lid 16 of smaller container 10 serves as a spacer between the inner wall of container 12 and the outer wall of container 10. The air space 4 between the containers enables one to grasp the sides of container 12 even when the container contains hot food. Furthermore, the large container supports the inner container out of contact with the surface 30 thereby avoiding marring (by heat or cold), which might otherwise occur if it made direct contact with the bottom of container 10.

Figure 6:
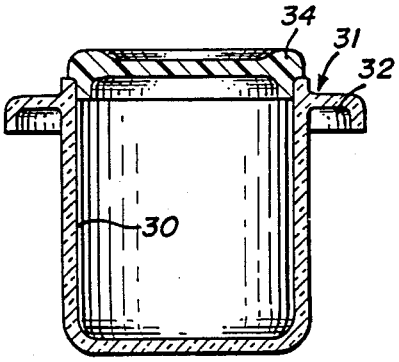
FIG. 6 shows a container with a lip.
Figure 7:
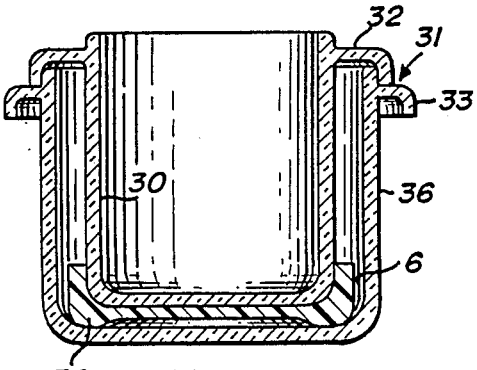
FIG. 7 shows a double walled container with lips.

An alternate embodiment of the invention is shown in FIG. 6 which shows the small container 30 with a flat annular flange or downturned lip 32 spaced downwardly from and around its top edge. An auxiliary inner lid 34 is shown positioned on top and lid 16 (FIG. 3) could be used in place of it, with the lid's bottom rim face 25 contacting upper surface 31 of flange 32. In FIG. 7, smaller container 30 is shown nested inside a larger container 36 in which case the lip 32 of the small container is shown resting on the top surface 31 of flange 33, or it may engage the top edge of the larger container 36 as lid 18 does for container 12 (FIG. 5). The lid 38 may be placed on the bottom of the smaller container 30 so as to help maintain the desired uniform spacing between the inner surface of the large container 36 and the outer surface of the small container 30.

Figure 10:
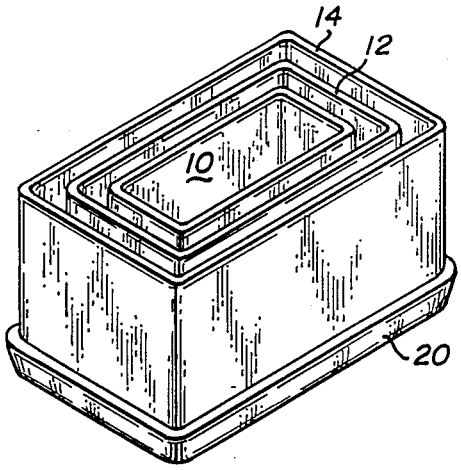
FIG. 10 shows a container having a rectangular cross section.
Figure 9:
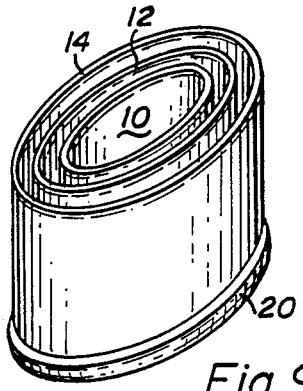
FIG. 9 shows a container having an elliptical cross section.

In FIGS. 1 to 7, the containers are shown as erect cylinders. However, this invention includes other shapes as well. In general, the scope of the invention includes containers having a curved, elliptical or polygonal cross section. For example, FIG. 9 shows a container 28 with an elliptical cross section. FIG. 10 shows a container 26 with a rectangular cross section.

Figure 8:
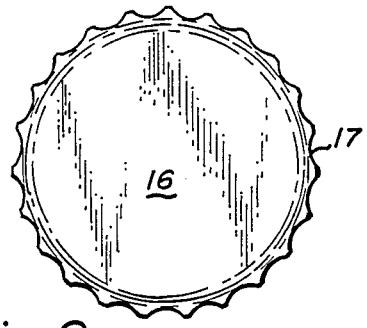
FIG. 8 shows a lid with a scalloped rim.

FIG. 8 shows a top view of any one of the lids, e.g., 16, which may have a scalloped rim 17 which provides air passages to the space between the bottoms of the nested rims so that the lid does not become stuck due to a vacuum that would otherwise occur when the containers are nested with the lid in the bottom space. In this embodiment, the spaces 6, 7 may be reduced to a minimum.

Figure 11:
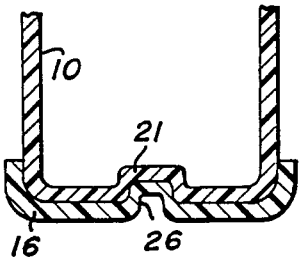
FIG. 11 shows a preferred embodiment with a container recess and lid inner surface mating knob.
Figure 12:
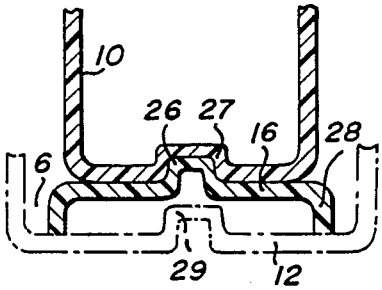
FIG. 12 shows a lid having a top surface button engaging a recess in the bottom of the container nested in a larger second container.

The preferred embodiments of FIGS. 11 and 12 illustrate in cross-section the use of a raised button or knob 26 in lid 16 to engage a mating recess 27 in the bottom of container 10. FIG. 11 shows the embodiment where the button 26 is in the inside face of the lid, while FIG. 12 shows the knob on the outside face of the lid. FIG. 12 also shows the nesting of this button-lid embodiment in a larger container 12, with enough rise from the lid edge lip 28 to clear button recess 29 of larger container 12. Note the clearance gap 6.

In accordance with the objects of the invention, the foregoing describes a system of containers, each having a lid, that may be used for holding food. Each container, with lid attached, may be nested with the other containers to conserve space when stored. Two containers, together, provide a double-wall container that provides thermal insulation.

It should be understood that various modifications within the scope of this invention can be made by one of ordinary skill in the art without departing from the spirit thereof. For example, containers may be designed so that the smaller inside containers are elevated slightly above the subsequently larger container to permit viewing of the indicia from the side. We therefore wish our invention to be defined by the scope of the appended claims as broadly as the prior art will permit, and in view of the specification if need be.

We claim:

1. A storage system which comprises:

(a) a plurality of containers, each container having an open top and a bottom and a size different from the size of any of the other containers to permit storing all of said containers as a nested set of containers graduated in size;

(b) a lid for each container, each of said lids being adapted to be attached to said top of its corresponding container and attachable to said bottom of said same container to permit said container and its lid to be secured together and stored with the lid on the bottom of its container as a part of said nested set; and (c) said lid for each container having an outer rim, said outer rim being spaced from the inner wall of the next larger container in which it rests to provide a gap so that said lid does not get wedged in said next larger container.

2. A storage system as in claim 1 wherein:

(a) said lid attached to said bottom of a smaller one of said containers nested in a larger container provides a uniform space between the outside of said smaller container and the inside of a larger container in which it is nested to form a single container assembly having a double wall; and (b) said space providing air gap insulation between the walls of said container.

3. A storage system as in claim 1 wherein;

(a) each said container has a wall surface and an open top edge, and which includes:

(i) indicia disposed on said wall surface near said top edge representing the size of each said container to be viewable when stored with said lid attached to said container bottom by virtue of space maintained between said containers by said attached lid.

4. A storage system as in claim 2 wherein said lid of said larger container fits over said larger container and said smaller container simultaneously.

5. A storage system as in claim 1 wherein:

(a) each said container has a top edge and includes:
(i) a lip having a lower surface extending around at least a portion of said top edge; and
(ii) said lower surface of said smaller container lip is disposed in supporting contact with said top edge of said larger container when said smaller container is nested inside said larger container.

6. A storage system as in claim 1 wherein each of said lids includes a rim having an outside surface that is scalloped to facilitate withdrawal of nested containers with lids attached.

7. A storage system as in claim wherein said storage containers have an elliptical horizontal cross-section.

8. A storage system as in claim I wherein said storage containers have rectangular horizontal cross-section.

9. A storage system as in claim 1 wherein:
(a) each of said lids includes at least one protrustion forming a knob; and
(b) each of said container bottoms includes a recess for receivingly engaging said knob to retain said lid to said container bottom.

10. A storage system as in claim 9 wherein said knob is disposed on the upper outer surface of said lid.

11. A storage system as in claim 9 wherein said knob is disposed on the inner surface of said lid.

12. A storage system as in claim 1 wherein:
(a) each of said container bottoms includes a protrusion forming a knob not extending below the outer juncture of said container side wall with said container bottom; and
(b) each of said lids includes at least one recess for receivingly engaging said knob to retain said lid to said container bottom.

13. A storage system as in claim 12 wherein said recess is disposed in an upper outer surface of said lid.

14. A storage system as in claim 12 wherein said recess is disposed in the inner surface of said lid.

15. A storage system as in claim 4 wherein:
(a) each of said lids includes at least one protrustion forming a knob; and
(b) each of said container bottoms includes a recess for receivingly engaging said knob to retain said lid to said container bottom.

16. A storage system as in claim 15 wherein said knob is disposed on the upper outer surface of said lid.

17. A storage system as in claim 15 wherein said knob is disposed on the inner surface of said lid.

18. A storage system as in claim 2 wherein:
(a) each of said lids includes at least one protrustion forming a knob; and
(b) each of said container bottoms includes a recess for receivingly engaging said knob to retain said lid to said container bottom.

19. A storage system as in claim 18 wherein said knob is disposed on the upper outer surface of said lid.

20. A storage system as in claim 18 wherein said knob is disposed on the inner surface of said lid.

* * * * *